United States Patent [19]

Babinsky et al.

[11] 4,056,448

[45] Nov. 1, 1977

[54] PROCESS FOR BRINE MEMBRANE CELL OPERATION WITH EXTERNAL CAUSTIC AND NaCl CONCENTRATION CONTROL

[75] Inventors: Andrew D. Babinsky, Chagrin Falls, Ohio; Ronald L. Dotson, Cleveland, Tenn.

[73] Assignee: Diamond Shamrock Corporation, Cleveland, Ohio

[21] Appl. No.: 751,644

[22] Filed: Dec. 17, 1976

[51] Int. Cl.[2] ..... C25B 1/16; C25B 1/00

[52] U.S. Cl. ..... 204/98

[58] Field of Search ..... 204/98, 12.8

[56] References Cited

FOREIGN PATENT DOCUMENTS

| | | | |
|---|---|---|---|
| 2,503,652 | 8/1975 | Germany | 204/98 |
| 2,311,556 | 9/1973 | Germany | 204/98 |

*Primary Examiner*—R. L. Andrews

*Attorney, Agent, or Firm*—John P. Hazzard

[57] ABSTRACT

Optimum current efficiencies are attained and maintained in a membrane chlor-alkali electrolytic cell by the constant, precise control of both the brine and caustic concentrations at each membrane phase boundary. Such control requires recycling through external holding tanks wherein the concentrations are adjusted to 560 grams per liter caustic and 190 grams per liter brine. Turbulent flow of such concentrations in the cells helps maintain the optimum concentration and also decreases the diffusion layer.

3 Claims, No Drawings

PROCESS FOR BRINE MEMBRANE CELL OPERATION WITH EXTERNAL CAUSTIC AND NaCl CONCENTRATION CONTROL

A large portion of the chlorine and caustic produced throughout the world is manufactured in diaphragm-type electrolytic cells wherein the opposed anode and cathode are separated by a fluid permeable diaphragm, usually of asbestos, defining separate anolyte and catholyte compartments. In operation, saturated brine is fed to the anolyte compartment wherein chlorine is generated at the anode, the brine percolating through the diaphragm into the catholyte compartment wherein sodium hydroxide is produced in a concentration within the range of 11–18 percent and "contaminated" with large amounts of sodium chloride. This sodium chloride must then be separated from the caustic and the caustic in turn concentrated by evaporation to provide a commercial product.

Through the years, substitution of a membrane material for the diaphragm has been proposed. These membranes are substantially impervious to hydraulic flow. In operation, brine is again introduced into the anolyte compartment wherein chlorine is liberated. Then, in the case of a cation perm-selective membrane, sodium ions are transported across the membrane into the catholyte compartment. The concentration of the relatively pure caustic produced in the catholyte compartment is determined by the amount of water added to this compartment from a source exterior the cell and osmotic water through the membrane. While operation of a membrane cell has many theoretical advantages, its commercial application to the production of chlorine and caustic has been hindered owing to the often erratic operating characteristics of the cells.

U.S. Pat. No. 3,773,634 describes the state of the art process and is the closest prior art known to applicants. In this patent, a membrane type process for producing chlorine and caustic is disclosed. The membrane utilized is a cation permselective membrane of the type useful in the method of present invention. The patent teaches control of the process by means of controlling only the sodium chloride concentration which in turn controls the caustic concentration.

STATEMENT OF INVENTION

Therefore it is an object of the present invention to provide an improvement in the operation of membrane-type electrolytic cells for the production of chlorine and caustic.

It is a further object of the present invention to provide an improvement in the operation of such membrane cells whereby stability of operation is achieved at a maximum current efficiency.

These and further objects of the present invention will become apparent to those skilled in the art from the specification and claims which follow.

An improvement has now been found in a process for the electrolysis of an aqueous sodium chloride solution in an electrolytic cell, the anolyte and catholyte compartments of which are separated by an electrolytically conductive, hydraulically impervious cation-permselective membrane, which improvement consists essentially of establishing and maintaining a sodium hydroxide concentration in the catholyte as close as possible to 560 grams per liter and at the same time establishing and maintaining the continuously recycling brine at a concentration as close as possible to 190 grams per liter. Concentrations can, of course, vary slightly from the above noted concentrations with corresponding decreases in current efficiencies. In any event, both brine and caustic concentrations should be maintained within 20 grams per liter of the preferred concentrations given above. Current should be maintained in the range 0.75 to 1.25 ASI, preferably at 1 ASI.

Recycling of the brine should be continuous with the proper concentration being maintained by appropriate additions of saturated brine. Also, the recycle rate and mechanics should be such as to effect rapid mixing or turbulent flow conditions in the anolyte in the area of the anode and membrane which decreases the diffusion layer, improves current efficiencies, allows low pH and low chlorate production, and results in higher sodium ion activities.

The preferred method of maintaining the requisite concentrations in anolyte and catholyte is to effect the necessary concentration adjustments outside of the cell or cells involved. Normally large installations have multiple cells in series and such outside concentration adjustment obviates the need and much greater expense of making controlled additions of water and saturated brine to each cell as a single concentration adjustment tank can supply the feed for all such cells in series.

The anolyte having had its concentration adjusted external of the cell by saturated brine addition is preferably passed more rapidly than normal through the cell. This results in a more constant brine concentration throughout the cell and also helps decrease the diffusion layer as discussed earlier.

DETAILED DESCRIPTION OF THE INVENTION

The membrane cells to which the operational techniques of the present invention apply, as well as the other operating parameters, are for the most part conventional. Generally, an enclosure is provided and divided into two compartments by the membrane material. In one compartment, the catholyte compartment, is disposed an appropriate cathode, generally a metallic material, such as iron. The other compartment, the anolyte compartment, contains the anode — a conductive, electrolytically-active material, such as graphite or, more desirably, a dimensionally stable anode, e.g., a titanium substrate bearing a coating of a precious metal, precious metal oxide or other electrolytically-active corrosion-resistant material. The anolyte compartment is provided with an outlet for generated chlorine gas, an inlet for brine solution and an outlet for depleted brine. Similarly, the catholyte compartment will have outlets for liquid and gaseous products and an inlet through which sodium hydroxide solution is recycled.

In operation, a direct current is passed between the electrodes, causing the generation of chlorine at the anode and the selective transport of hydrated sodium ions across the membrane into the catholyte compartment where they combine with hydroxide ions formed at the cathode by the electrolysis of water, hydrogen gas being liberated.

In general a cell employing any permselective cation-exchange membrane electrolytically conductive in the hydrated state obtaining under cell conditions and useful in the electrolysis of brine is improved by the operational techniques characteristic of the present invention. Most often these membranes are sulfonated materials based upon a chemically-resistant highly cross-linked polymer backbone, such as a divinylbenzeneacrylic acid copolymer, polyethylene, divinylbenzene-polystyrene copolymers, polyvinylfluorocarbon ethers and the like. Particularly preferred at this time, because of their apparent superiority in a membrane cell for the electrolysis of sodium chloride, are the membranes manufactured and sold by the E. I. duPont de Nemours & Co. under the trademark of NAFION® membranes and based upon a completely fluorinated vinyl ether polymer containing pendant sulfonic acid groups and having an equivalent weight within the range of 1,100 - 1,300, preferably about 1,200 (grams of polymer per equivalent of proton) and an average gel water content within the range of 15–40 percent. Thus, generally, a useful membrane comprises a chemically and mechanically resistant polymer matrix or backbone to which are attached, in an extremely stable fashion, highly electronegative exchange sites, such as sulfonic, phosphonic or carboxylic acid groups. The desired high degree of electrolytic conductivity and high apparent sodium ion transport number are contingent upon the presence in these membranes of a considerable quantity, generally in excess of 15 weight percent on a dry resin basis, of gel water. A further understanding of these membranes and examples thereof may be found by reference to U.S. Pat. Nos. 2,636,851; 3,017,338; 3,496,077; 3,560,568; 2,967,807; 3,282,875 and British Pat. No. 1,184,321.

The thicknesses of membranes of the foregoing type employed are generally on the order of 4 - 20 mils. Greater thicknesses are useful, however, any incidental advantage in the use of such thicknesses is more than offset by the added cost of the material. With thicknesses of less than 10 mils, mechanical support, e.g., in the nature of a woven Teflon screen, is often advantageous.

Exemplary of other non-critical process parameters are operating temperatures within the range of 65° - 100° C., and feed brine pH within the range of 1.0 - 4.0.

The essence of the instant invention is that, in a permselective membrane chlor-alkali cell to maximize the efficiency requires control of both the brine concentration and the caustic concentration in the cell since they control the net membrane transport and permselectivity to hydroxyl ions which in turn determine current efficiency. This would appear to contradict the teachings of the closest prior art, U.S. Pat. No. 3,773,634. However, on closer inspection it does not. This prior art patent teaches to control both anolyte and catholyte concentration by actually controlling only the concentration of the brine solution. Such control is possible — but the caustic concentration will not be equilibrated thereby at the concentration of maximum efficiency. Only by actually controlling the concentration of both the anolyte and catholyte can both be maintained at the concentrations of maximum efficiency.

The operating concentrations of anolyte and catholyte which maximizes current efficiency is a brine concentration of about 190 grams per liter and a caustic concentration of about 560 grams per liter. These concentrations may vary ±20 grams per liter with resultant lessening of efficiency the further the concentration strays from the preferred concentration. For optimum current efficiencies, the current density should be in the range of 0.75 to 1.25 amperes per square inch (ASI), and preferably be 1 ASI. When operating at the preferred concentrations and current density, current efficiencies of 90% - 98% have been observed on a continuous basis using, for example, a 7-mil 25% gel water NAFION® 1,200 equivalent weight membrane.

In the practice of the present invention, the anolyte or brine solution is recycled through the cell. The concentration of salt within the cell is maintained as close as possible to about 190 grams per liter. The concentration can be maintained by either adding the requisite amount of saturated brine directly into the cell or the recycle stream. When more than one such cell are connected in series, it is preferred that the saturated brine be added to the recycle streams at a single point, adequately mixed to get a uniform concentration and then fed back to the cells for further electrolysis. In this system, no spent brine leaves the system and thus no dechlorination equipment is needed therefor.

In recycling the brine solution, it is preferred to increase the flow rate of the solution through the cell significantly over the rates normally practiced so as to minimize its residence time within the cell which maintains a more constant concentration within the cell. Furthermore, the higher flow rates within the cell effect greater mixing of the brine at the membrane-brine interface which decreases membrane polarization, increases diffusion rates from bulk to membrane which results in still higher current efficiencies and allows lower pH operation and lower chlorate production.

In addition to or in place of higher flow rates of the brine, it is preferred to have the fresh brine entering the cell be directed at the brine-membrane interface. This can effectively be done using a feed tube with appropriately directed nozzles. An example of such a device for effecting turbulent interfacial mixing would be a Torricelli Vortexer. Other means for minimizing the diffusion layer at the brine membrane interface could also be employed, such as vibration or the like.

In commercial membrane chlor-alkali cells which have a vacuum exerted on the chlorine-brine header, an imposed periodic variation in the vacuum exerted can effectively expose new brine at the membrane-brine interface on a continuous time scale and thereby decrease the thickness of the diffusion layer and reduce polarization.

In the cathode containing cell, the catholyte or caustic solution is recycled with the concentration being best maintained at 560 grams per liter by controlled addition of water to the recycle stream which after mixing to the prescribed uniform concentration is recycled to one or more cells. The caustic concentration is most important in maximizing current efficiency in that it maintains proper and stable swelling conditions and the resultant superior performance.

EXAMPLE

The cell comprises a cathode compartment containing a steel mesh electrode and separated from an anode compartment containing an expanded titanium electrode bearing a $2TiO_2$:$RuO_2$ mole ratio coating on its surface, by a duPont NAFION® cation exchange membrane as described above and having a thickness of 7 mils, a gel water content of 25 percent and an equivalent weight of 1200. The caustic in the cathode compartment was maintained at a constant concentration by constant addition of sufficient caustic at that concentration. Likewise, the brine concentration was maintained constant for each run. The electrolysis was conducted at differing applied anode current densities at a cell temperature of 85° C. The anolyte was stirred constantly in each run. The results of these runs were as follows:

| Run No. | Caustic g./l. | NaCl g./l. | ASI amps./in.$^2$ | Current Efficiency % |
|---|---|---|---|---|
| 1 | 540 | 182 | 1 | 98 |
| 2 | 565 | 185 | 1 | 98 |
| 3 | 560 | 196 | 1 | 96 |
| 4 | 544 | 190 | 1 | 94 |
| 5 | 546 | 186 | 1 | 92.6 |
| 6 | 548 | 174 | 1 | 91 |
| 7 | 550 | 164 | 1.43 | 89 |
| 8 | 500 | 204 | 1 | 88.4 |
| 9 | 590 | 210 | 1.53 | 88 |
| 10 | 508 | 182 | 1 | 87 |
| 11 | 562 | 210 | 1.5 | 85.5 |
| 12 | 528 | 202 | 1.43 | 85.3 |
| 13 | 554 | 200 | 1.27 | 83.2 |
| 14 | 534 | 180 | 1.6 | 83 |
| 15 | 508 | 204 | 1 | 82.5 |
| 16 | 508 | 202 | 1 | 81 |
| 17 | 643 | 220 | 1.43 | 76.6 |
| 18 | 570 | 248 | 1.31 | 72.8 |
| 19 | 570 | 254 | 1.31 | 70 |
| 20 | 544 | 235 | 1 | 73 |

While the invention has been described with reference to certain preferred embodiments thereof, it is not to be so limited since changes and alterations may be made therein which are well within the intended scope of the appended claims.

We claim:

1. In a process for the electrolysis of an aqueous sodium chloride solution in an electrolytic cell the anolyte and catholyte compartments of which are separated by an electrolytically-conductive, hydraulically impervious, cation permselective membrane, having an equivalent weight of approximately 1200, the improvement which consists essentially of establishing and maintaining the sodium hydroxide concentration in the catholyte within the range of about 540 –580 grams per liter by the addition of water from outside the cell and simultaneously establishing and maintaining the sodium chloride concentration in the anolyte within the range of about 170 to 210 grams per liter while maintaining the current density in the range 0.75 to 1.25 amperes per square inch.

2. A process as stated in claim 1 wherein the sodium chloride concentration is maintained by recycling the solution in the anolyte, adding sodium chloride thereto external of the cell and returning the replenished solution to the cell in such a manner that it impinges on the membrane and at a speed sufficient to reduce the diffusion layer associated with the solution-membrane interface.

3. A process as stated in claim 2 wherein the sodium hydroxide concentration in the catholyte is maintained by recycling the solution, adding water thereto externally of the cell and returning the adjusted solution to the cathode.

* * * * *